United States Patent [19]

Stahlecker

[11] 4,302,928

[45] Dec. 1, 1981

[54] SPINNING OR TWISTING SPINDLE WITH A ONE-PIECE SPINDLE TOP AND METHODS FOR MANUFACTURING SAME

[75] Inventor: Hans Stahlecker, Süssen, Fed. Rep. of Germany

[73] Assignee: Spindelfabrik Süssen, Schurr, Stahlecker und Grill GmbH, Süssen, Fed. Rep. of Germany

[21] Appl. No.: 48,026

[22] Filed: Jun. 13, 1979

[30] Foreign Application Priority Data

Jun. 15, 1978 [DE] Fed. Rep. of Germany ..... 2826152

[51] Int. Cl.[3] ..... D01H 7/04

[52] U.S. Cl. ..... 57/130

[58] Field of Search ..... 57/129, 130, 135

[56] References Cited

U.S. PATENT DOCUMENTS

| | | | |
|---|---|---|---|
| 2,417,485 | 3/1947 | Gleitz et al. | 57/135 |
| 2,463,484 | 3/1949 | Gelpke | 57/129 |
| 2,485,093 | 10/1949 | Gelpke | 57/130 |
| 2,536,618 | 1/1951 | Wood | 57/130 |
| 2,582,325 | 1/1952 | Gleitz et al. | 57/130 |
| 2,802,331 | 8/1957 | Multon | 57/130 |

FOREIGN PATENT DOCUMENTS 1016791 9/1952 France .

*Primary Examiner*—Donald Watkins
*Attorney, Agent, or Firm*—Craig and Antonelli

[57] ABSTRACT

A spinning or twisting spindle is formed of a one-piece metal spindle top having a spindle shank and a whirl formed of a die cast aluminum alloy, and preferably one containing more than 12 percent silicon in crystalline form. The spindle is formed according to preferred methods whereby the spindle top is die cast so as to produce a spindle that is overized relative to an intended final size, the cast spindle top is machined to its final size and a fixed connection is formed between the shaft and the spindle top. The connection, in one embodiment, is created by press fitting the shaft into an opening cast into an end of the spindle top, while in a second method, the connection is formed by die casting the spindle top about the shaft.

6 Claims, 3 Drawing Figures

SPINNING OR TWISTING SPINDLE WITH A ONE-PIECE SPINDLE TOP AND METHODS FOR MANUFACTURING SAME

BACKGROUND AND SUMMARY OF THE INVENTION

The invention relates to a spinning or twisting spindle with a one-piece metal spindle top, comprising a spindle shank and a whirl, said top being connected nonrotatably with a shaft.

It is conventional in modern spindles to make the spindle top of at least two parts, one of which is the spindle shank and the other is the whirl. The spindle shank usually consists of a wrought aluminum alloy. The drive whirl is usually made of steel. Both parts are connected together by the spindle shaft, to which both parts are fixedly connected. The manufacturing cost for such spindles is relatively high, so that these spindles are relatively expensive.

It is also known (French Patent No. 1 016 791) to provide a one-piece spindle top, i.e., to make the spindle shank and the whirl in one piece. It is merely indicated in this patent that this spindle top is to be made of metal or plastic. A spindle of this kind has not found any application in practice. A considerable increase in manufacturing cost would result if this one-piece spindle shank were made entirely of steel, since considerable machining costs would be required. It is not technically feasible to make the spindle top from a wrought aluminum alloy, since this spindle top would then have insufficient abrasion resistance in the vicinity of the whirl.

Thus, an object of the invention is to reduce the manufacturing cost and consequently the price of a spindle of the type described hereinabove. This goal is achieved by virtue of the fact that the spindle top is made in the form of a die-cast part manufactured and of a construction in accordance with the preferred embodiment described below.

This type of manufacture, i.e., die casting, is especially suitable for light spindles, since orders therefor usually reach a sufficiently high number of individual parts, so that the die casting mold does not cause a significant increase in the cost of the workpiece. A choice of material, in accordance with the described embodiments, permits manufacturing spindle tops that have sufficient strength and require only slight additional machining.

In an advantageous embodiment of the invention, the spindle top is made in the form of a die cast part which is slightly oversize relative to its intended final size, and is then machined by copying or profile grinding of its exterior with reference to a pattern part. This ensures that all spindles have exactly the same dimensions and a surface finish of the desired quality is achieved.

In an especially advantageous embodiment of the invention, it is provided that the die cast part is cast over the shaft inserted in the die casting mold. This further simplifies manufacture, since no additional work steps are required to connect the shaft to the spindle top.

It has been found advantageous in practice to make the spindle top of an aluminum alloy. In this connection, it is advantageous for the aluminum alloy to contain more than 12% silicon. This silicon component, which is above the eutectic point, has an especially advantageous effect upon abrasion resistance. The fraction of the silicon which exceeds 12% is not included in the alloy, but occurs in crystalline form, so that it is precisely this fraction which increases abrasion resistance considerably.

These and further objects, features and advantages of the present invention will become more obvious from the following description when taken in connection with the accompanying drawings which show, for purposes of illustration only, several embodiments in accordance with the present invention.

DETAIL DESCRIPTION OF THE PREFERRED EMBODIMENT

Figure 2:
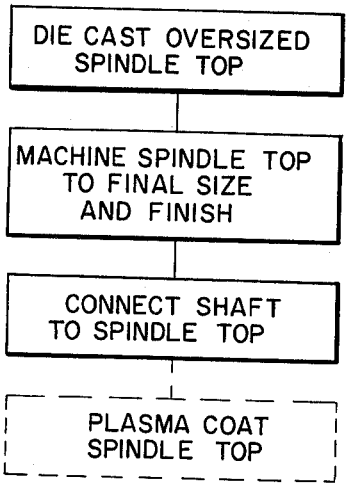
FIGS. 2 and 3 diagrammatically represent methods according to the invention for producing the spindle of FIG. 1.
Figure 1:
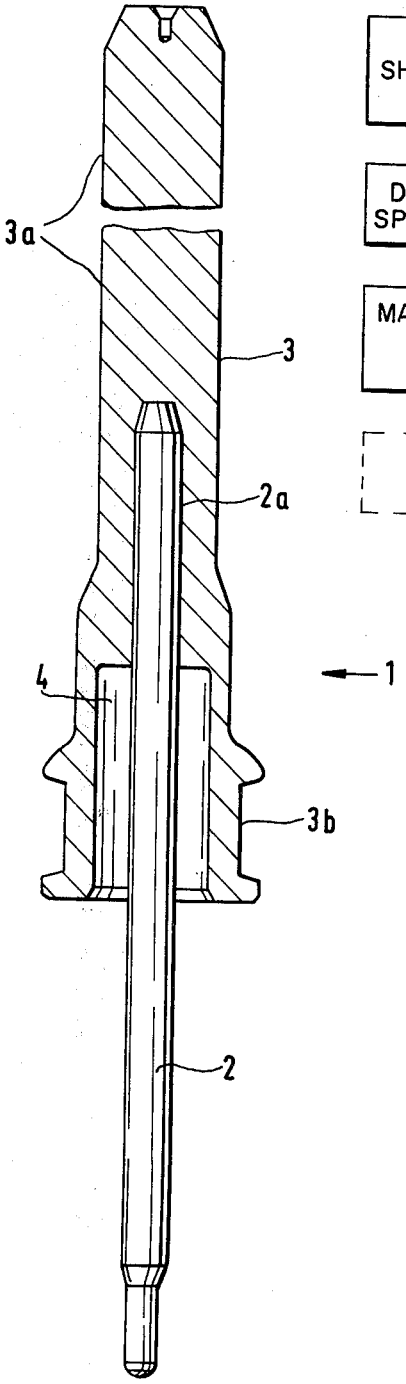
FIG. 1 is an axial section through a spindle according to the invention.

Spindle 1 shown in the drawing consists of a shaft 2 made of steel, said shaft being fixedly connected with a spindle top 3 so as to be rotatable therewith. In use, shaft 2 is inserted in the usual fashion in a spindle bearing housing, whereby it is mounted in a footstep bearing and a topstep bearing. The topstep bearing is disposed, in a manner not shown, in the spindle bearing housing in the vicinity of a drive whirl 3*b*, said whirl being located at the lower end of spindle top 3. Above drive whirl 3*b*, spindle top 3 is provided with a so-called spindle shank 3*a*, which is cylindrical in shape and serves to accept the cores of bobbins. In the vicinity of whirl 3*b*, spindle top 3 is provided with a pot-shaped recess 4, within which spindle top 3 accepts a bearing head, not shown, of the spindle bearing housing.

Spindle shaft 2 projects approximately halfway out of the lower end of spindle top 3. Its upper area 2*a* is fixedly connected with spindle top 3 in a manner preventing relative rotation therebetween.

The spindle top 3 is a one-piece body, i.e., whirl 3*b* and spindle shank 3*a* are made in one unitary piece. Manufacturing of the spindle top 3 is performed by die casting, preferably using an aluminum alloy which contains at least 10% silicon and advantageously more than 12% silicon, said silicon being present in crystalline form and being capable of ensuring increased abrasion resistance. An especially advantageous material as far as wear properties and die casting properties as well are concerned is AlSi 18 CuMgNi, containing 17 to 19% silicon, 0.8 to 1.5% copper, 0.8 to 1.3% magnesium, and more than 1.3% nickel. In addition, this material contains as trace elements, up to 0.7% iron, up to 0.2% titanium, up to 0.2% manganese, and up to 0.3% zinc.

The spindle top is made as a die cast part, approximately 0.3 to 0.4 mm. oversize. The final shape is achieved by copying, with the exterior of the spindle top being machined in conformance with a pattern piece, in other words, the exterior of spindle shank 3*a* and whirl 3*b*. The area of recess 4 is not machined. This final machining, which can be performed by profile grinding, ensures an advantageous surface finish.

Figure 3:
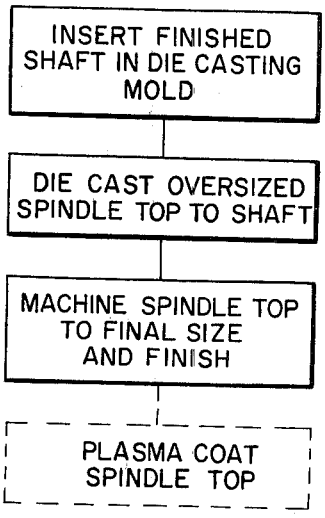

In order to connect shaft 2 with spindle top 3, an axial bore can be provided in spindle top 3, into which end 2*a* of shaft 2 is press-fitted in the method according to FIG. 2. Another, more economical possibility for producing the spindle according to the invention is represented in FIG. 3 and consists in inserting shaft 2 into the die casting mold and injection die casting spindle top 3 onto shaft 2. Shaft 2 is machined to its final shape before being inserted in the die casting mold, whereby it not only receives its final shape but also its final surface finish. The connection formed between spindle top 3 and area 2*a* of shaft 2 is also sufficient in this casting process to accept the pulling forces applied in use. Optionally, a contour in the form of a flattening or a polygon can be provided in area 2*a* of spindle shaft 2, with or without an undercut, so that a certain closure of the mold can be achieved both circumferentially and axially, and so as to ensure that relative rotation between the shaft and spindle top 3 is avoided.

Spindle top 3 can also be made of other special aluminum alloys, whereby the alloy is selected to achieve Brinell hardnesses of more than 80. Brinell hardnesses of 130 to 140 can be achieved with known alloys.

Since spindle top 3 is subjected to increased wear, especially in the vicinity of whirl 3*b*, it is advantageous for this area to be protected by a wear-resistant coating, especially if the spindle top is made of an aluminum alloy which does not exhibit sufficient hardness and wear resistance. Especially advantageous in this connection is the use of the so-called plasma coating method, wherein an adhesive layer of an alloy of 70% nickel and 30% aluminum is provided, powdered, and then applied by plasma coating, after which, a plasma coating composed of chromium dioxide and a mixture of 60% chromium oxide and a powdered mixture of chromium oxide, aluminum oxide, and titanium oxide is then applied as a plasma coating. The plasma coating of the spindle is an optional step applicable to either of the FIG. 2 or FIG. 3 methods as represented by the dashed-line shown therein.

It is noted that all of the machining, die casting, and plasma coating operations utilized in accordance with the present invention are techniques well known per se. Accordingly, these matters have not been described in detail either as to equipment utilized or operations performed, since they will be apparent to those of ordinary skill in the art, and since this invention does not relate to these operations per se, but rather relates to the use of various steps and materials in combination to produce the spindle described, as well as to the resultant spindle.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A spinning or twisting spindle with a one-piece metal spindle top comprising a spindle shank and a whirl, said spindle top being connected to a shaft in a manner precluding relative rotation therebetween, wherein the spindle top is a die cast part made of an aluminum alloy, wherein the aluminum alloy contains more than 12% silicon.

2. A spinning or twisting spindle according to claim 1, characterized by the fact that the spindle top is provided with a wear-resistant coating in the vicinity of the whirl.

3. A spinning or twisting spindle according to claim 1, wherein said aluminum alloy is AlSi 18 CuMgNi containing 17 to 19% silicon, 0.8 to 1.5% copper, 0.8 to 1.3% magnesium, more than 1.3% nickel and trace elements of up to 0.7% iron, up to 0.2% titanium, up to 0.2% manganese, and up to 0.3% zinc.

4. A spinning or twisting spindle according to claim 3, wherein said shaft is formed of steel.

5. A spinning or twisting spindle according to claim 2, wherein the wear resistant coating comprises a plasma coating of an adhesive formed of an alloy of 70% nickel and 30% aluminum and a plasma coating formed from a powdered mixture of chromium oxide aluminum, aluminum oxide and titanium oxide.

6. A spinning or twisting spindle according to claim 3, characterized by the fact that the spindle top is provided with a wear-resistant coating in the vicinity of the whirl.

* * * * *